US007650852B2

(12) United States Patent
Clifford et al.

(10) Patent No.: US 7,650,852 B2
(45) Date of Patent: Jan. 26, 2010

(54) MODULAR PAINTING APPARATUS

(75) Inventors: Scott J. Clifford, Rochester Hills, MI (US); Eric D. Buchanan, Oxford, MI (US); James M. Kowalski, Lake Orion, MI (US); Roy A Jerue, Bloomfield Hills, MI (US); Paul D. Copioli, Sterling Heights, MI (US); Mike G. Beem, Sterling Heights, MI (US)

(73) Assignee: Fanuc Robotics America, Inc., Rochester Hills, MI (US)

( * ) Notice: Subject to any disclaimer, the term of this patent is extended or adjusted under 35 U.S.C. 154(b) by 0 days.

(21) Appl. No.: 10/691,763

(22) Filed: Oct. 23, 2003

(65) Prior Publication Data

US 2004/0107900 A1 Jun. 10, 2004

Related U.S. Application Data

(60) Provisional application No. 60/420,612, filed on Oct. 23, 2002, provisional application No. 60/420,971, filed on Oct. 24, 2002, provisional application No. 60/423,636, filed on Nov. 4, 2002.

(51) Int. Cl.
*B05C 11/10* (2006.01)

(52) U.S. Cl. ..... 118/681; 118/305; 118/315; 118/316; 118/323; 901/29; 901/43

(58) Field of Classification Search ..... 118/680, 118/681, 695, 704, 706, 629, 315, 316, 305, 118/323; 901/43, 29; 427/421, 8
See application file for complete search history.

(56) References Cited

U.S. PATENT DOCUMENTS 4,721,630 A * 1/1988 Takeo et al. ..... 427/421
4,781,517 A * 11/1988 Pearce et al. ..... 414/590
4,896,274 A * 1/1990 Hohn et al. ..... 700/247
4,931,322 A 6/1990 Yamamoto et al.
5,240,745 A * 8/1993 Yamamoto et al. ..... 427/421
5,296,029 A * 3/1994 Neikter ..... 118/326
5,336,321 A * 8/1994 Sugata et al. ..... 118/315
5,738,727 A * 4/1998 Cebola et al. ..... 118/631
5,744,190 A * 4/1998 Thome ..... 427/8
5,766,355 A * 6/1998 Josefsson et al. ..... 118/326

FOREIGN PATENT DOCUMENTS

DE 101 19 906 A1 * 10/2002
EP 0 084 523 7/1983
WO WO 01/34309 5/2001

OTHER PUBLICATIONS

Translation of German Patent No. 101 19 906 A1 by Otto Nuesser (aka as Nuber), published Oct. 24, 2002.*
Williamette Valley #105920, Preliminary Robcad Reach Study, Fanuc P-200T 5.0 Meter Linear Travel Robot, pp. 1-3.
FANUC Robotics North America, Inc. P-200T Product Brochure, Feb. 2001, pp. 1-2.

* cited by examiner

*Primary Examiner*—George R Koch, III
(74) *Attorney, Agent, or Firm*—Fraser Clemens Martin & Miller LLC; William J. Clemens

(57) ABSTRACT

An apparatus for processing objects includes an elevated tubular frame rail mounting a four axis robot arm with a tool such as a painting applicator. The robot is attached to a mounting base that moves along the rail permitting painting of the top and/or side of a vehicle body. Electrical power and fluid lines can be routed through the rail to the robot. Two such rails and multiple robots can be combined as a module for installation in a new or an existing painting booth.

41 Claims, 6 Drawing Sheets

MODULAR PAINTING APPARATUS

CROSS-REFERENCE TO RELATED APPLICATION

This application claims the benefit of U.S. provisional patent application Ser. No. 60/420,612 filed Oct. 23, 2002, the U.S. provisional patent application Ser. No. 60/420,971 filed Oct. 24, 2002, and the U.S. provisional patent application Ser. No. 60/423,636 filed Nov. 4, 2002.

BACKGROUND OF THE INVENTION

The present invention relates generally to robotic painting systems and, in particular, to an apparatus, method, and system for painting external surfaces of vehicle bodies.

Prior art paint booths are well known. A typical prior art paint booth, used to paint the exterior surfaces of vehicle bodies in both continuous conveyance and stop station systems, includes an enclosure housing a plurality of paint applicators. In one configuration, the applicators are mounted on an inverted U-shaped support structure that includes two vertical supports, one on either side of the path of travel of the bodies, connected at their tops by a horizontal support. This support structure is used to paint the top surfaces of the body and the horizontal beam can be fixed or can have an additional degree of freedom to move along the top of the vehicle body being painted. Another painting device is used in the same painting zone to paint the sides of the body and generally does not have the capability to move laterally along the length of the body. Disadvantages of this type of painting apparatus include lack of flexibility to provide optimized standoff distance between the body surface and the applicator along with inefficient use of the allotted painting cycle time. In the case of the top surface painting machine, the paint applicators are mounted on a common beam: therefore, the distance between each paint applicator and the surface to be painted varies with the contours of the vehicle body. In the case of the side painting machine, the paint applicators do not move transverse to the path of the vehicle body. They can only paint the portion of the body that is in front of the applicator leaving a good portion of the available cycle time unused.

An alternative to the support structure has been floor-mounted robots disposed along the sides of the painting booth. The robots mount either spray guns or rotary applicators (bell machines) for directing atomized paint toward the vehicle body.

While rotary applicators have advantages over spray guns, there are some associated disadvantages. The prior art floor mounted robots, especially bell machines, are inherently very costly and limit visual access to the booth. The bell machines require more bells for the same throughput due to limited orientation capability. The additional bells use more paint per vehicle due to per bell paint waste during color changing. Prior art floor mounted robots also require significant booth modification when installed in existing paint booths, increasing installation time and cost, and require more booth length and width. The rail axis of floor mounted robots requires doors at both ends of the booth. The waist axis of the floor mounted robot requires an additional safety zone at the ends of the spray booth and the rail cabinets of the floor mounted robots encroach into the aisle space. Floor mounted robots also require frequent cleaning due to the down draft of paint overspray causing paint accumulation on the robot arm and base, which results in higher maintenance and cleaning costs.

The prior art bell zone machines also lack flexibility. Additional and more flexible robot zones are required because the prior art machines unable to reach substantially all paintable surfaces on one side of the body and, therefore, have limited backup capability for an inoperative painting machine. Additional robot zones are also used to provide backup capability for the less flexible prior art painting machine.

It is desirable, therefore, to provide a painting apparatus and a painting system that utilizes robots in an efficient and cost-effective manner that minimizes paint waste, occupies little space (length and width) in the paint booth and can be installed in existing paint booths without requiring significant booth modification. It is also desirable to provide a painting apparatus wherein one painting robot is able to reach substantially all paintable surfaces on one side of the article to provide backup capability in the case of an inoperative robot.

SUMMARY OF THE INVENTION

The present invention concerns an apparatus, method, and system for painting objects in a paint booth or similar enclosure.

The present invention concerns a modular elevated rail adapted to be mounted in a paint booth for automated painting of conveyed articles such as automotive vehicle bodies. The modular elevated rail includes a frame enclosure having overhead-mounted rails straddling the line of conveyance of the articles. The conveyed articles may be moving or stationary during the painting process. The frame enclosure allows for higher rigidity and lower weight than is attained by conventional free standing, cantilevered rail mounts and occupies less space and realizes lower cost and less floor loading. At least one painting robot is mounted on a mounting location on the rail frame to move alongside, and at a higher elevation than, the articles such as to protect the rails from paint overspray and reduce the cost of covers for, maintenance of, and cleaning of the rails. The elevated rail frame in accordance with the present invention may be advantageously incorporated as part of a new paint booth assembly or installed as a retrofit device without requiring significant modification to the existing paint booth. The tubular arrangement of the modular elevated rail allows pre-wiring to be done at the production facility as opposed to an on-site wiring installation, providing numerous cost and quality-control benefits.

Preferably, a robot that provides four degrees of freedom is mounted on the frame rail, which provides another axis of freedom. The robot mounting location allows one painting robot to reach substantially all paintable surfaces on one side of the article in a degraded mode of operation. Preferably, opposed robots are provided for symmetric painting of the article. The robot primary axes (robot arms) advantageously operate in a vertically extending planar space. When an axisymmetric paint applicator, such as a rotary bell, is mounted on the robot for painting, a sixth degree of freedom (orientation about the robot wrist faceplate) is not required as in the prior art. The sixth degree of freedom may be added if the application requires an asymmetric applicator.

The combination of the arm geometry of the robot and the mounting location of the elevated rail provides higher bell on time with minimal impact on booth size, allowing fewer robots to be installed in a small booth, and permitting use for painting in the space provided by existing booths.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
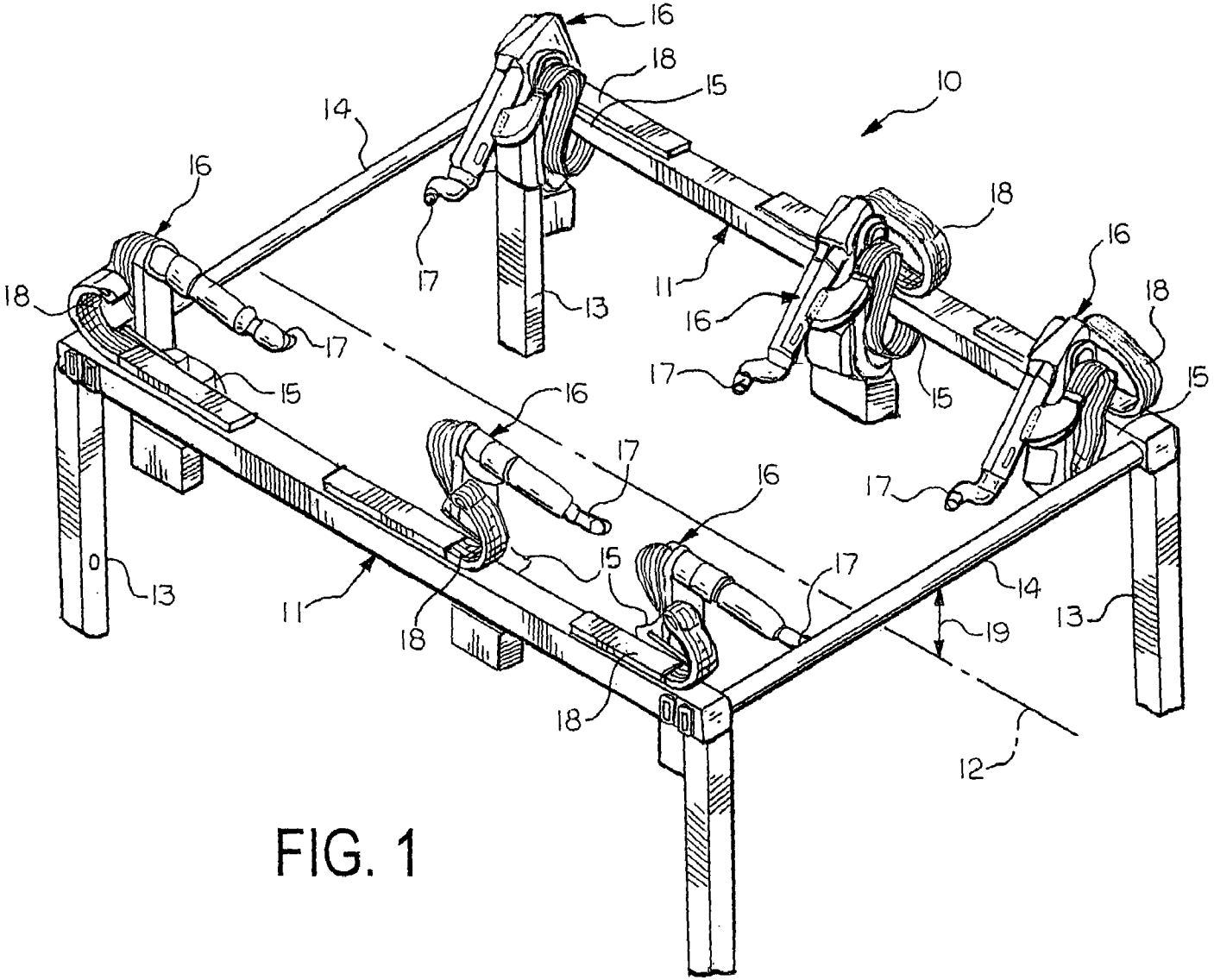
FIG. 1 is a perspective view of a modular elevated rail apparatus in accordance with the present invention.

There is shown in FIG. 1 a modular elevated rail apparatus 10 for painting articles or objects in accordance with the present invention. The elevated rail apparatus 10 is adapted to be disposed in a paint booth as discussed below. The apparatus 10 includes a pair of frame rails 11 extending in a horizontal direction and spaced apart a predetermined distance on opposite sides of an axis 12 defining a path of travel for objects to be painted. Each end of each of the frame rails 11 is supported on an upper end of an associated one of a plurality of legs 13 adapted to engage a floor of the painting booth. Corresponding ends of the frame rails 11 can be connected by cross support members 14 that cooperate with the frame rails 11, the legs 13 and the booth floor to form a modular, supporting rigid box frame structure of the apparatus 10. If required for support, additional ones of the legs 13 and the members 14 can be attached intermediate the ends of the frame rails 11. The cross supports 14 may be substituted by a booth structure specifically designed to couple the two frame rails 11 in a rigid box frame structure.

The frame rails 11 each have at least one mounting base 15 attached thereto. Three such bases 15 are shown on each of the rails 11. Each of the mounting bases 15 is adapted to retain a painting device 16. The preferred painting device 16 is a robotic four axis articulated arm terminated at a free end by a paint applicator 17. The arm includes a shoulder axis, an elbow axis, a wrist rotating axis and a wrist tilting axis. Although a rotary bell atomizer is shown as the paint applicator 17, any known device such as a spray gun could be used. The painting device 16 and the mounting base 15 move together parallel to the longitudinal axis 12 to provide a fifth axis of movement. The painting device 16 is provided with electrical power and fluids, such as paint, compressed air and solvent, through a flexible ribbon 18 connected between the painting device and the frame rail 11. Preferably, the painting devices 16 are mounted in opposed pairs for simultaneously painting opposite surfaces of an object such an automobile body or the like (not shown) conveyed through the apparatus 10 along the axis 12. If the shown location of the axis 12 represents the top surfaces of the objects being painted, the frame rails 11, the support members 14 and the mounting bases 15 may be advantageously spaced a predetermined vertical distance 19 above the horizontal plane containing the axis 12.

The elevated rail apparatus 10 can easily be installed as a new painting booth is constructed, or as a retrofit to an existing paint booth without requiring significant modification to the existing paint booth. The frame rails 11, the legs 13 and the support members 14 can be brought into a painting booth and assembled into the rigid frame structure. Although the elevated rail apparatus 10 is described in terms of a painting process, the paint applicator 17 can be any tool suitable for performing a process on an object conveyed to the space between the two rails 11.

Figure 2:
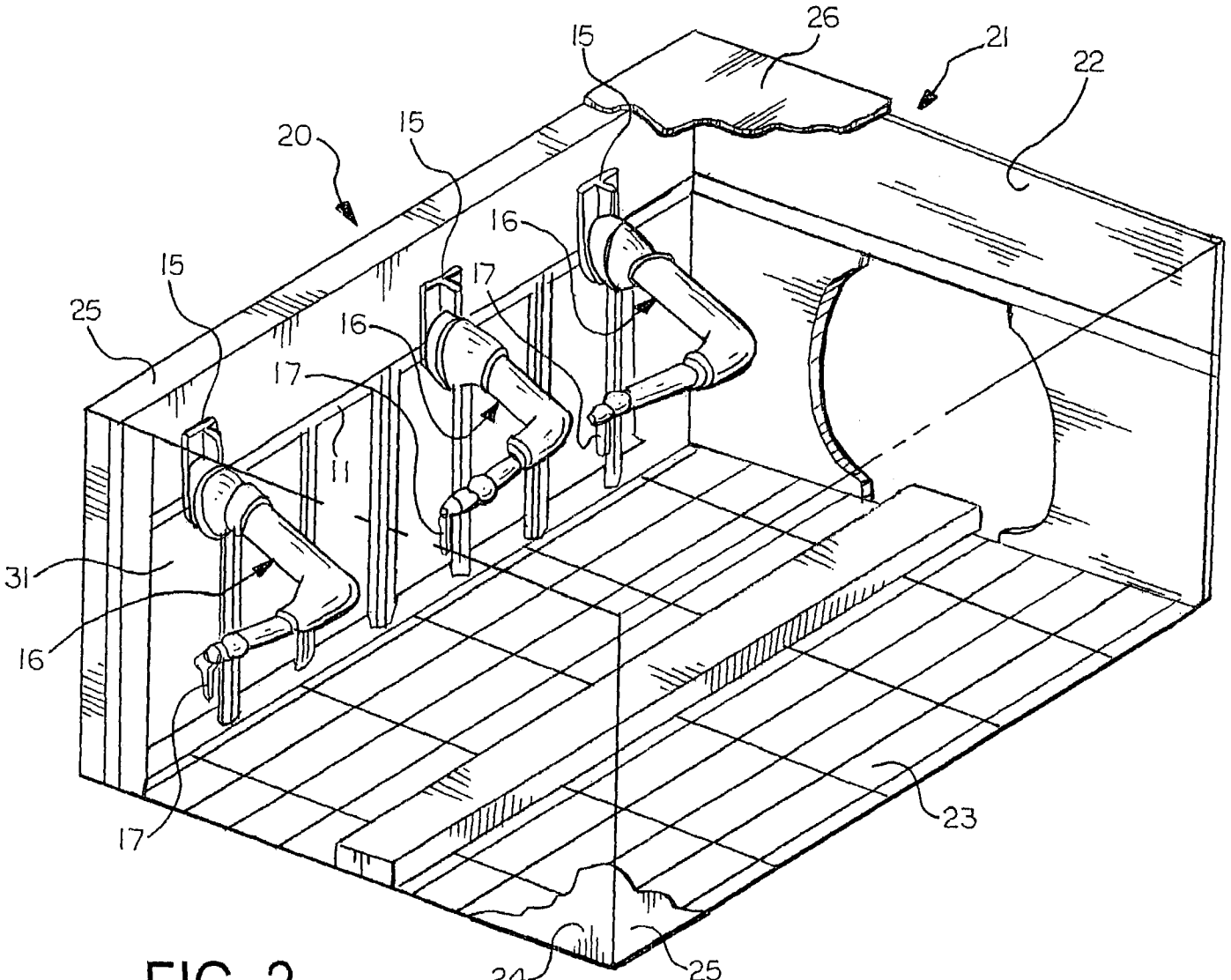
FIG. 2 is fragmentary perspective view of an alternate embodiment of the elevated rail apparatus according to the present invention shown installed in a painting booth.

An alternate embodiment of the elevated rail apparatus according to the present invention is shown in FIG. 2 as an apparatus 20 installed in a painting booth 21. The painting booth 21 includes a rear or exit wall 22, a lower wall or floor 23, a front or entrance wall 24, a pair of side walls 25 and a top wall or roof 26. The right side wall 25, the front wall 24 and the top wall 26 are cut away to permit the interior of the booth 21 to be seen. The walls 22 through 26 are connected together to define an enclosed space in which the elevated rail apparatus 10 of FIG. 1 may be advantageously disposed. However, the alternate embodiment elevated rail apparatus 20 is adapted to be disposed in an upper portion of the paint booth 21 on the side walls 25. The apparatus 20 includes the frame rail 11 extending along an interior surface of the left side wall 25. The frame rail 11 can be attached to the side wall 25 by any suitable means. A second one of the frame rails 11 (not shown) is positioned on the opposite interior surface of the right side wall 25 such that the booth connects the frame rails 11 in a rigid frame structure. Movably attached to the frame rails 11 are the mounting bases 15 with the painting devices 16 and the painting applicators 17.

Figure 3:
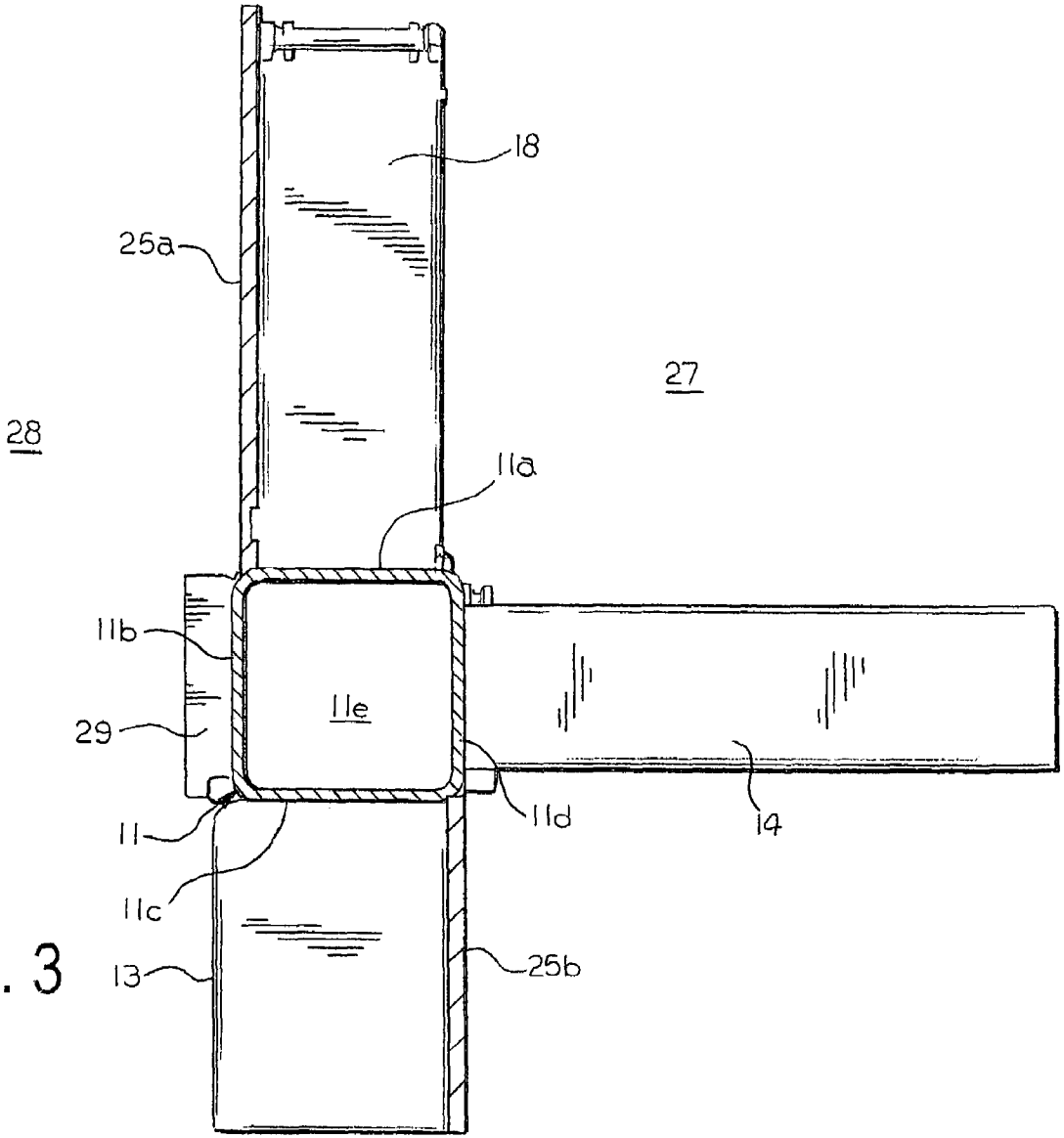
FIG. 3 is a fragmentary cross sectional view of a portion of the elevated rail apparatus of FIG. 1 installed in a painting booth in a first configuration.

There is shown in FIG. 3 a portion of the apparatus 10 at a side wall of the painting booth. The side wall is split with an upper portion 25*a* above the frame rail 11 and a lower portion 25*b* below. The upper portion 25*a* abuts an upper surface 11*a* of the frame rail 11 near an outer side surface 11*b*. The lower portion 25*b* abuts a lower surface 11*c* of the frame rail 11 near an inner side surface 11*b* to which the cross support member 14 is attached. Thus, the frame rail 11 forms a part of the side wall separating an interior space 27 of the painting booth from an aisle 28 outside the booth. The frame rails 11 are made of tubular stock and are preferably rectangular in cross section having a hollow interior 11*e*. Alternatively, the frame rails 11 are formed from any shape of tubular stock including, but not limited to, circular stock. A coupling conduit 29 is attached to the surface 11*b* for routing electrical and fluid lines from the aisle 28 into the interior 11*e* of the frame rail 11. The cross support members 14 also are tubular for routing electrical and fluid lines. The frame rails 11 and the cross supports 14 can be sealed, purged and pressurized to function in the painting booth environment.

Figure 4:
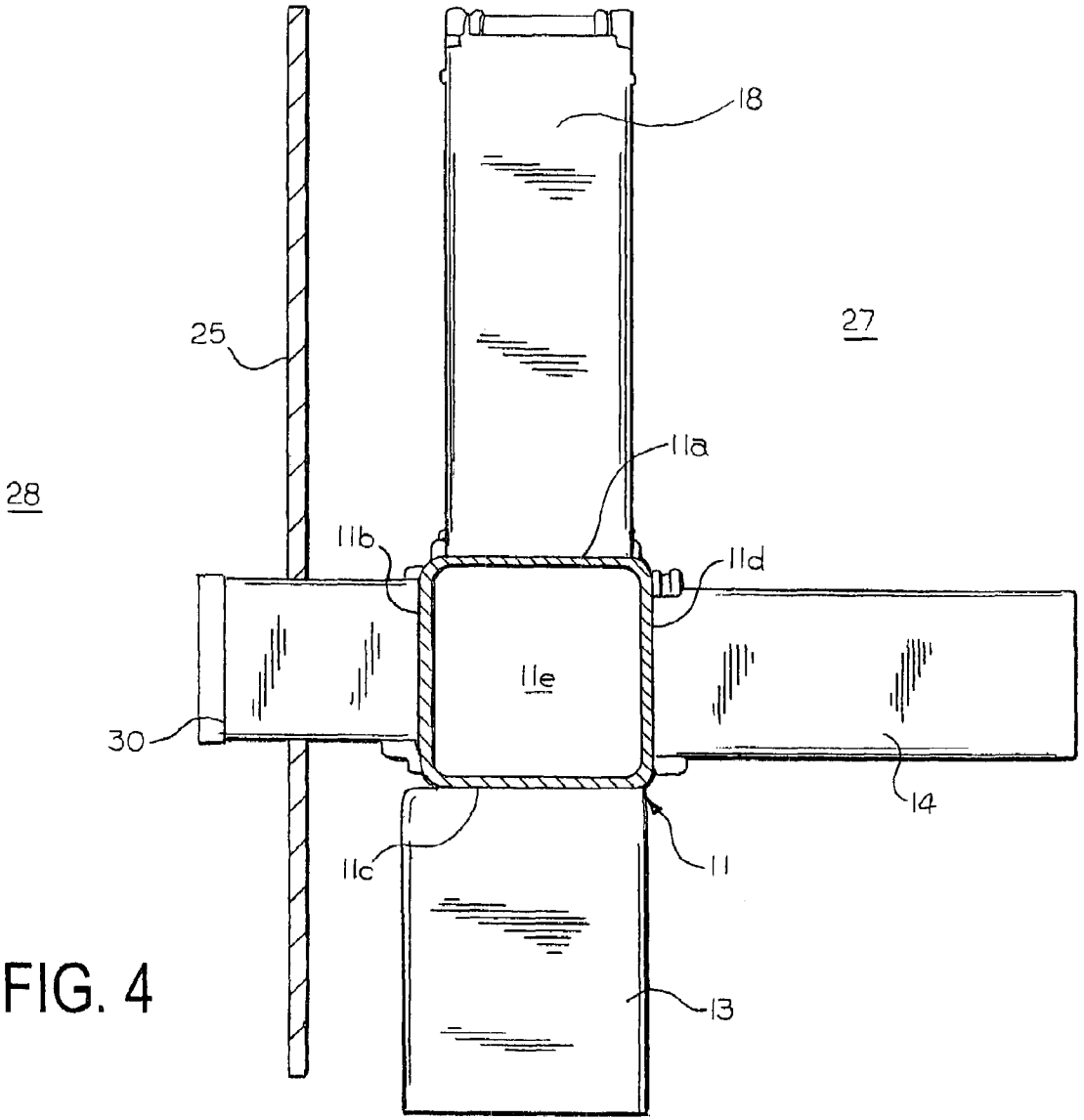
FIG. 4 is a fragmentary cross sectional view similar to FIG. 3 showing the elevated rail apparatus installed in a painting booth in a second configuration.

There is shown in FIG. 4 a portion of the apparatus 10 at the side wall 25 of the painting booth wherein the entire apparatus 10 is located in the interior 27 of the booth. A coupling conduit 30 is attached to the surface 11*b* for routing electrical and fluid lines into the interior 11*e* of the frame rail 11. The coupling conduit 30 extends through the side wall 25 into the aisle 28.

Elevating the frame rails 11 above the path of the upper surfaces of the objects being painted allows a simple means for connecting the cross support members 14 between the opposing frame rails providing a path for any supply lines. Thus, the electrical power and fluid sources can be located in the aisle 28 adjacent the exterior of the left side wall 25, for example, to supply the painting devices 16 on both sides of the booth. Also, it is advantageously less costly than adding support steel to the paint booth to support the cantilever loads of traditional prior art floor mounted robot rails.

In addition, elevating the frame rails 11 places many of the typical maintenance components such as linear axis drive components and cable and hose carriers (not shown) out of the area where the paint overspray would typically accumulate on equipment in a prior art down draft spray booth. These components do not need to be protected against the overspray as diligently as a prior art floor mounted rail. This advantageously lowers the cost for protective covers and seals (not shown) while lowering the ongoing maintenance cost over the life of the robots 16. Elevating the frame rails 11 also permits unobstructed viewing into the paint booth 21, through windows 31 (see FIG. 2) provided in the side wall 25, which is a benefit for system operators. The elevated rail apparatus 10 and 20 also allows access doors (not shown) to be placed in the side walls 25 when they would typically be located at the rear wall 22 and the front wall 24 of the booth 21. This again reduces the overall length of the booth 21.

Furthermore, elevating the frame rails 11 above the object, such as a vehicle body, to be painted allows the booth 21 to be made narrower than required for a traditional five to seven axis robot and does not require installation of components in the aisle 28 that are typically found in prior art floor-mounted installations. The elevated frame rail 11 and the robots 16 also advantageously allow the arm of each of the robots, discussed in more detail below, to reach under itself and paint the side of the vehicle because the robot base is not trapped between the side wall 25 and the vehicle.

As shown in FIGS. 1 and 2, a plurality of the articulated arm robots 16 is attached to the elevated frame rails 11 at various mounting bases 15 that move along the rails and allow the applicators 17 to follow an object to be painted, such as a vehicle body (not shown), as it moves through the paint booth 21. The applicators 17 are preferably a circular spray pattern bell applicator. By installing multiple articulated arm robots 16 on the common frame rails 11, the vehicle can be processed with each applicator 17 spraying for a higher percentage of time, and requiring fewer of the robots 16 and corresponding applicators 17 as compared to floor mounted systems.

With a simplified robot 16, the design of the structural elements of the elevated rail apparatus 10 and 20 (the frame rail 11, the legs 13 and the cross supports members 14) are fit within the narrow width space limitations of a standard bell zone paint booth 21. Furthermore, utilizing the elevated rail apparatus 10 in conjunction with the higher flexibility of a multi-axis manipulator, discussed in more detail below, yields higher application efficiencies, and thereby reduces the length overall length of a traditional bell zone paint booth 21.

Figure 5:
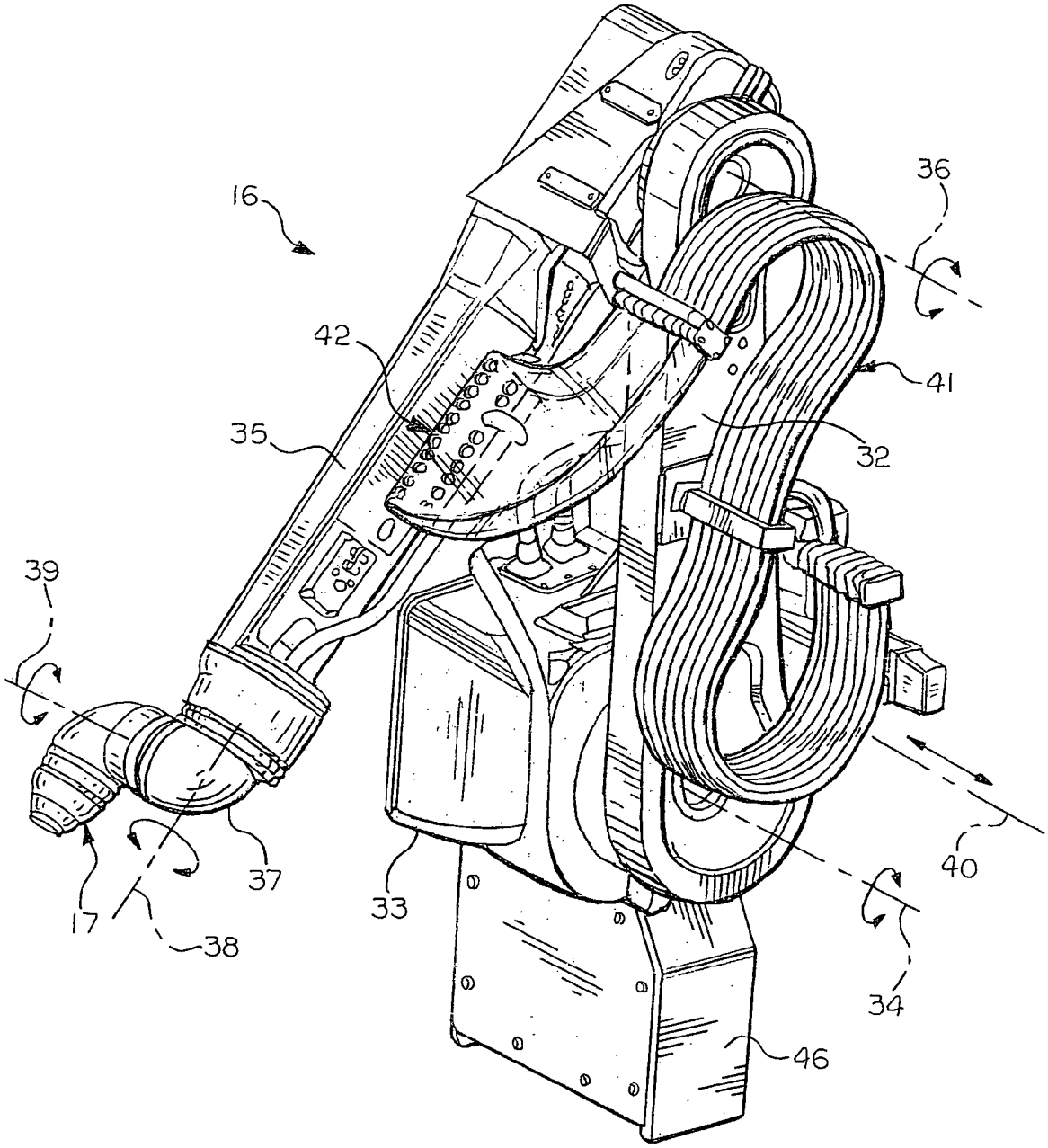
FIG. 5 is a perspective view of one of the painting robots shown in FIG. 1.

As shown in FIG. 5, the preferred painting device 16 is a four axis articulated arm robot terminated at a free end of the arm by the paint applicator 17 shown as a rotary bell applicator. The robot 16 includes a first or inner arm portion 32 mounted at a first end to a robot base 33 for rotation about a shoulder axis 34. A second or outer arm portion 35 is mounted at a first end to a second end of the inner arm 32 for rotation about an elbow axis 36. A wrist 37 attaches the paint applicator 17 to a second end of the outer arm 35 and has a rotating axis 38 and a tilting axis 39. The wrist 37 rotates the applicator 17 about the axis 38 which is generally parallel to a longitudinal axis of the outer arm 35 and rotates the applicator 17 about the axis 39 to tilt the applicator relative to the axis 38. Thus, the robot 16 provides four axes of motion relative to the base 33 for movement of the arm portions 32 and 35, the wrist 37 and the applicator 17 in vertical planes. A fifth axis of motion is a rail axis 40 provided through the attachment of the robot base 33 to the mounting base 15 (FIG. 1) for reciprocating movement of the robot 16 along the horizontal longitudinal axis of the associated frame rail 11 (FIG. 1).

Preferably, the structural components of the outer arm portion 35 and the wrist 37 are formed from a non-conductive material having suitable structural strength and impervious to the corrosive properties of solvents used in the painting environments, such as Lauramid A material. "Lauramid" is a registered trademark of Albert Handtmarm ELTEKA Verwaltungs-GmbH of Biberach, Germany. The Lauramid A material is a castable polyamide Nylon 12G material that also provides for electrostatic isolation, cleanliness, cleaning capability, and weight advantages. Grounding of internal gearing (not shown) in the wrist 37 and other conductive components is not necessary for use in the paint booth 21 because they are suitably insulated. Non-grounded components are advantageously less likely to attract paint overspray resulting in a cleaner robot 16 requiring less maintenance and having better transfer efficiency of the paint to the vehicle, all resulting in less operating cost. The conductive components could also be charged at a lower or the same potential as the spray applicator.

A plurality of paint lines 41 is routed along the side of the inner arm 32 and connect to a color changer 42 mounted in the outer arm 35. The outer arm 35 houses a paint canister (not shown) for receiving a supply of paint through a selected one of the lines 41 and dispensing the paint to the applicator 17. Also housed within the outer arm 35 is a high voltage cascade (not shown) for electrostatically charging the paint for application to the object being painted.

Figure 6:
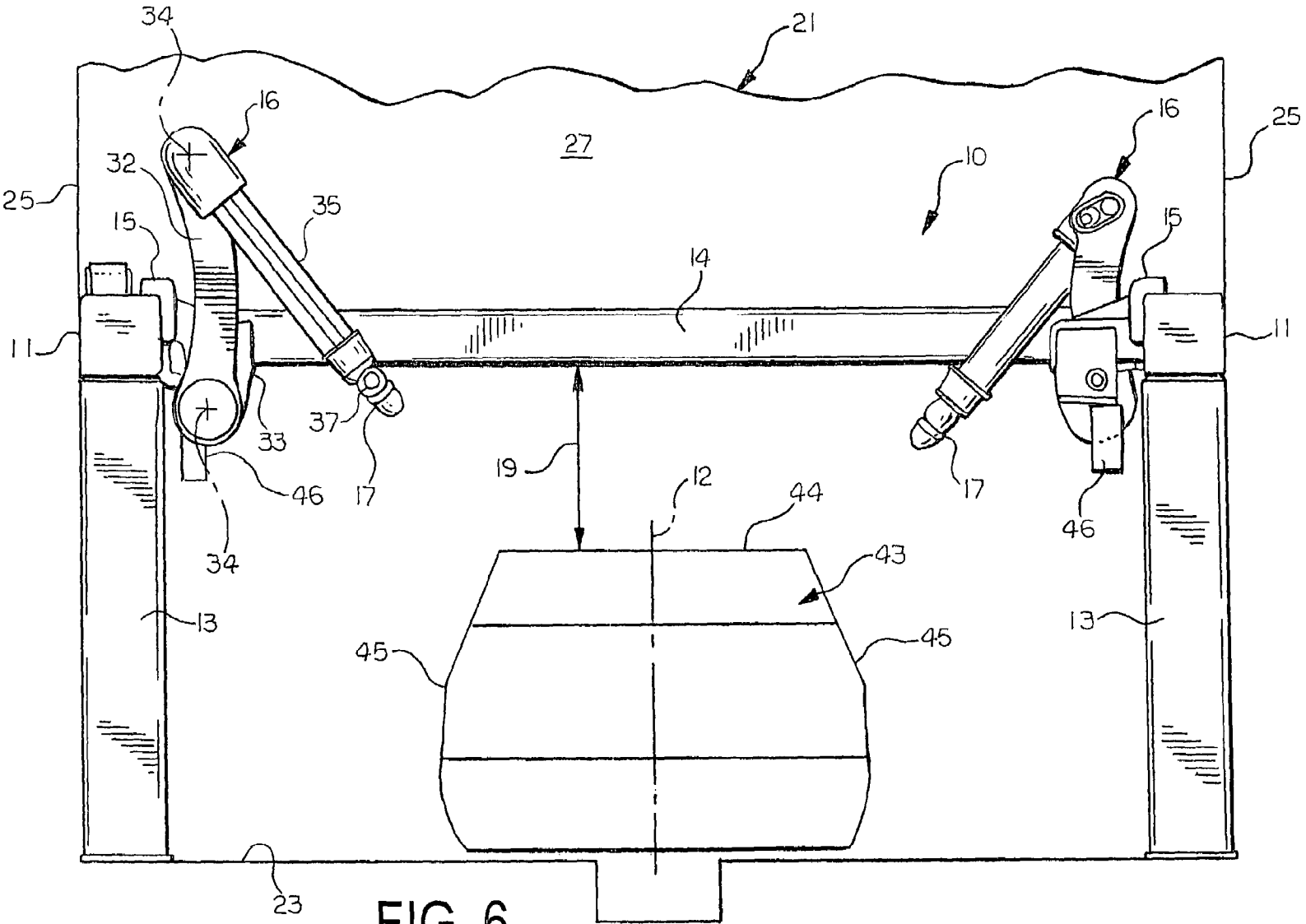
FIG. 6 is a front elevation view of the elevated rail apparatus of FIG. 1 installed in a painting booth for painting a vehicle body.

FIG. 6 shows the elevated rail apparatus 10 installed in the interior 27 of the painting booth 21 for painting a vehicle body 43. The base 33 and the shoulder axis 34 of each of the robots 16 are located above the horizontal plane of the axis 12 of movement of an upper surface of the vehicle body 43 while the shoulder axis 34 is located below the frame rail 11 which maximizes the capability of the robots. A one of the robots 16 dedicated to painting the top 44 of the vehicle body 43 can advantageously paint a side 45 of the vehicle body if necessary in a degrade mode, such as if a one of the robots 16 dedicated to painting the side fails, because of the extension capabilities that the translation axes 34 and 36 provide. In addition, the elevated frame rails 11 and cross support members 14 allow for the placement of an enclosed process controller 46 (FIGS. 5 and 6), which includes pneumatic valves and bell control components (not shown), below the robot base 33 and in the paint booth 21, in an easily accessible type X purge enclosure.

The robot 16 being attached to the movable mounting base 15 on the elevated frame rail 11 allows the applicator 17 to follow the vehicle body 43 as it moves through the booth 21. By utilizing multiple opposed robots 16 on opposed frame rails 11, and by using a line tracking motion capability, the vehicle body 43 can be painted with each applicator 17 spraying for a high percentage of the available cycle time. For example, the robots 16 adjacent to the exit wall 22 (FIG. 2) can be spraying a portion of one vehicle body while the robots 16 adjacent to the entrance wall 24 can be spraying a portion of another vehicle body. Alternatively, if the vehicle body is conveyed to a stop within the space between the two rails 11, the robots 16 may still move along the rails to reach and paint all body surfaces desired to be painted.

The robot primary axes 34 and 36 advantageously operate the robot arm portions 32 and 35 in a vertically extending planar space orthogonal to the axis 12. Opposed robots 16 are provided for symmetric painting of objects such as the vehicle body 43. Preferably control lines (not shown) are run through, or along, the cross support members 14 in order for a single controller (not shown) to control a pair of the opposed robots 16 for painting the opposite sides of the vehicle body 43.

The geometry of the robot 16 and the mounting base 15 allows one painting robot to reach substantially all paintable surfaces on the top 44 and one side 45 of the vehicle body 43 in a degraded mode of operation. The elevated rail apparatus 10 or 20 advantageously provides for the use of multiple robots 16 on the same frame rail 11 having the capability to paint various size vehicle bodies 43 within the paint booth 21. The geometry of the robot 16 and the elevated mounting location also eliminates human safety issues associated with placing traditional prior art robots in proximity of manual spray zones. Because the robot 16 is a planar device operating in a plane orthogonal to the longitudinal axis of the frame rail 11 and does not have a waist axis as in the prior art floor mounted painting robots and rail robot systems, the robot 16 does not extend the applicator 17 beyond the ends of the spray zone with an appreciable reduction in booth length. Furthermore, the geometry of the robot 16 and the elevated mounting location allows the robot to extend underneath the frame rail 11 into a protected enclosure (not shown) so that the robot can be serviced while the remaining robots 16 in the paint booth 21 continue painting. The protected enclosure has provisions for use of dynamic limiting devices to ensure operator safety.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A modular apparatus for painting surfaces of a vehicle body moved along a path comprising:

a modular apparatus including two guide rails; and at least one robot located on and movable along the length of each of said two guide rails;

said guide rails comprising a pair of frame rails located on opposite sides of and extending generally parallel to the path of movement of the vehicle body, said frame rails being located above a plane of an upper surface of the vehicle body as the vehicle body travels the path, said frame rails being fixedly mounted on a rigid frame structure that prevents movement of one of said frame rails relative to another of said frame rails;

said at least one robot comprising a first and a second robot arm mounted on an associated one of each of said frame rails, each of said first and second robot arms being slidably movable along said associated frame rail and having a shoulder axis and an elbow axis for movement only in a generally vertical plane transverse to the path of movement of the vehicle body, said shoulder axes being positioned below said associated frame rail; and a paint applicator mounted on each of said first and second robot arms for dispensing paint whereby each of said first and second robot arms is sized to move said paint applicator relative to the vehicle body while said paint applicators dispense paint to cover the upper surface and adjacent side surfaces of the vehicle body with the paint.

2. The apparatus according to claim 1 wherein each of said first and second robot arms includes a wrist mounting said paint applicator, said wrist having a rotating axis and a tilting axis for moving said paint applicator relative to the vehicle body.

3. The apparatus according to claim 1 wherein each of said first and second robot arms moves in a generally vertical plane transverse to the path of movement of the vehicle body to dispense the paint.

4. The apparatus according to claim 1 wherein said frame rails are mounted on walls of a paint booth extending generally parallel to the path of movement of the vehicle body.

5. The apparatus according to claim 1 wherein said frame rails are mounted on floor engaging legs.

6. The apparatus according to claim 1 wherein said frame rails are tubular.

7. The apparatus according to claim 1 wherein said frame rails are connected by at least one cross support member located above the plane of the upper surface of the vehicle body.

8. The apparatus according to claim 7 wherein said frame rails and said at least one cross support member are tubular.

9. The apparatus according to claim 1 including control means maintaining said first and second robot arms in opposition to provide symmetric painting of the vehicle body.

10. The apparatus according to claim 1 wherein each said shoulder axis extends parallel to and is offset horizontally from an axis of travel along said associated frame rail.

11. The apparatus according to claim 1 wherein each said shoulder axis extends parallel to and is offset horizontally from an axis of travel along said associated frame rail toward the path of movement of the vehicle body.

12. A modular apparatus for painting a vehicle body having an upper surface and opposed side surfaces and being conveyed along a path comprising: a modular apparatus including two guide rails; and at least one robot located on and movable along the length of each of said two guide rails;

said guide rails comprising a pair of frame rails extending along opposite sides of and generally parallel to the path of conveyance of the vehicle body;

at least two legs attached to each said frame rail for supporting said frame rails above a plane of the upper surface of the vehicle body on the path;

at least one cross member fixedly connecting said frame rails together as a rigid frame structure that prevents movement of said frame rails, fixes said frame rails relative to one another and to said plane, and minimizes a width of said rigid frame structure relative to a width of the vehicle body;

said at least one robot comprising at least one robot arm located on an associated one of each of said frame rails, said at least one robot arm being movable along said associated frame rail generally parallel to the path and being pivoted at a shoulder axis positioned below said associated frame rail; and a paint applicator mounted on each said at least one robot arm for applying paint to the vehicle body whereby each of said at least one robot arms pivots at said shoulder in a generally vertical plane to permit each of said at least one robot arms to reach said paint applicator to all paintable areas on the upper surface and an adjacent one of the side surfaces of the vehicle body.

13. The apparatus according to claim 12 wherein each of said at least one robot arm has an inner arm portion pivoted at one end at said shoulder axis and pivotally connected at an opposite end to an outer arm portion at an elbow axis.

14. The apparatus according to claim 12 wherein each said at least one robot arm includes a process controller mounted for movement therewith along said associated frame rail.

15. The apparatus according to claim 14 wherein said at least one cross support member is hollow and receives cables and conduits connecting said process controllers together.

16. The apparatus according to claim 14 wherein said at least one cross support member is tubular and purged with an inert gas or air for explosion protection.

17. The apparatus according to claim 12 wherein each said at least one robot arm includes a wrist connecting a free end of said at least one robot arm and said paint applicator, said wrist having two axes of motion.

18. The apparatus according to claim 12 wherein each said at least one robot arm has only four axes of motion including said shoulder axis for orienting said paint applicator relative to the vehicle body.

19. The apparatus according to claim 12 wherein each said shoulder axis extends parallel to and is offset horizontally from an axis of travel along said associated frame rail.

20. The apparatus according to claim 12 wherein each said shoulder axis extends parallel to and is offset horizontally from an axis of travel along said associated frame rail toward the path.

21. A modular apparatus for painting surfaces of a vehicle body moved along a path though a paint booth comprising:

a modular apparatus comprising at least one horizontally extending guide rail; and at least one robot arm including a controller mounted on said rail for travelling along said rail; wherein said guide rail comprises a pair of frame rails mounted on opposite sides of and extending generally parallel to the path of movement of the vehicle body through the paint booth, said frame rails being fixedly located above a plane of an upper surface of the vehicle body as the vehicle body travels the path; and said at least one robot comprises a first and a second robot arm mounted on an associated one of each of said frame rails, each of said first and second robot arms being movable along said associated frame rail and having a shoulder axis and an elbow axis for movement only in a generally vertical plane transverse to the path of movement of the vehicle body, said shoulder axes being positioned below said associated frame rail; and a paint applicator mourned on each of said first and second robot arms for dispensing paint whereby said first and second robot arms are sized to move said paint applicators relative to the vehicle body while said paint applicators dispense paint to cover the upper surface and an adjacent side surface of the vehicle body with the paint;

wherein said control means is connected to each of said first and second robot arms for selectively dispensing the paint in a normal mode wherein different areas of the upper surface and the adjacent side surface are covered by said paint applicators of each of said first and second robot antis and a degraded mode wherein the upper surface and the adjacent side surface are covered by said paint applicator of one of said first and second robot arms.

22. The apparatus according to claim 21 wherein said first robot arms are positioned in opposition and said second robot arms are positioned in opposition to provide symmetric painting of the vehicle body.

23. The apparatus according to claim 21 wherein said control means includes a separate process controller mounted on an associated one of each of said first and second robot arms for movement along said associated frame rail, each said process controller operating said associated robot arm in the normal mode and the degraded mode.

24. The apparatus according to claim 21 wherein each of said first and second robot arms includes a wrist mounting said paint applicator, said wrist having a rotating axis and a tilting axis for moving said paint applicator relative to the vehicle body.

25. The apparatus according to claim 21 wherein said frame rails are mounted on walls of a paint boot extending generally parallel to the path of movement of the vehicle body.

26. The apparatus according to claim 21 wherein said frame rails are mounted on floor engaging legs.

27. The apparatus according to claim 26 wherein frame rails are connected by at least one cross support member located above the plane of the upper surface of the vehicle.

28. The apparatus according to claim 27 wherein said frame rails and said at least one cross support member are tubular and receive cables and conduits connecting said first and second robot arms together.

29. The apparatus according to claim 21 wherein each of said first and second robot arms has four axes of movement including said shoulder axis and an elbow axis defining a planar operating space for said paint applicator transverse to the path of movement of the vehicle body and including a wrist rotating axis and a wrist tilting axis for moving said paint applicator.

30. A modular apparatus for painting surfaces of a vehicle body moved along a path comprising:

a modular system including two guide rails; and at least one robot located on and movable along the length of each of said two guide rails;

said guide rails further comprising a pair of frame rails located on opposite sides of and extending generally parallel to the path of movement of the vehicle body, said frame rails being elevated above a plane of an upper surface of the vehicle body as the vehicle body travels the path, said frame rails being mounted on a fixed rigid frame structure that prevents movement of one of said frame rails relative to another of said frame rails, and prevents movement of said frame rails relative to said plane; and a first and a second robot arm mounted on an associated one of each of said frame rails, each of said first and second robot arms having a carriage movable along an associated one of said frame rails, first and second arm links, and mounting means for mounting a paint applicator at an end of said second arm link, three parallel axes of movement including a first linear axis wherein said carriages move along said associated frame rails, a second rotational axis located below said first liner axis for rotating said first arm link relative to said carriage and a third rotational axis spatially separated from said second rotational axis by said first arm link for rotating said second arm link relative to said first arm link whereby movement of a paint applicator attached to said mounting means is restricted to a generally vertical plane transverse to the path of movement of the vehicle body and movement along the path of movement of the vehicle body;

said robot arms further comprising a paint applicator mounted on each of said first and second robot arms for dispensing paint whereby each of said first and second robot arms is sized to move said paint applicator relative to the vehicle body while said paint applicators dispense paint to cover the upper surface and adjacent side surfaces of the vehicle body with the paint.

31. A modular apparatus for processing an article moved along a path comprising:

a modular system including two guide rails; and at least one robot located on and movable along the length of each of said two guide rails;

said robot including a control system;

said robot having six axes of motion and being connected to said control system for controlling movement of said robot, said modular system having a frame structure including first and second linear and parallel guide rails, a first carriage supported on said first guide rail and movable along a first of said six axes and a second carriage supported on said second guide rail and movable along a second of said six axes, a first arm link rotationally coupled at one end to said first carriage at a third of said six axes and rotationally coupled at another end to a second arm link at a fourth of said six axes, a third arm link rotationally coupled at one end to said second carriage at a fifth of said six axes and rotationally coupled at another end to a fourth arm link at a sixth of said six axes, wherein said third and fifth axes are located below said first and second guide rails and above a to surface of the article, and process tool mounting means supported at terminal ends of said second and fourth arm links, wherein said first and second guide tails are elevated above the article on opposite sides of the path and said six axes are parallel to the path.

32. The apparatus according to claim 31 wherein said first through fourth axes are fixed in space relative to one another as said robot performs process operations on the article.

33. The apparatus according to claim 31 wherein said mounting means is a robotic wrist mechanism having at least one rotational axis for providing directional orientation to a process tool mounted on said wrist mechanism.

34. The apparatus according to claim 31 including a paint applicator mounted on each of said mounting means and wherein the article is a vehicle body to be painted.

35. The apparatus according to claim 34 wherein the first and second arm links are sized to move said paint applicator relative to the vehicle body while said paint applicator dispenses paint to cover an upper surface and adjacent sides of the vehicle body with the paint.

36. The apparatus according to claim 31 wherein said frame structure has at least one hollow beam member.

37. The apparatus according to claim 31 wherein said control system is mounted in at least one of said carriages and is movable along an associated one of said first and second guide rails.

38. A robot for processing an article moved along a path comprising;

a modular system including two guide rails; and at least one robot located on and movable along the length of each of said two guide rails;

said robot including a control system conjoined with and movable with said robot; and wherein said guide rails form a robot base including a frame structure having linear and parallel first and second guide rails;

a first carriage supported on said first guide rail and movable along a first axis;

a second carriage supported on said second guide rail and movable along a second axis;

a first link mechanism rotationally coupled to said first carriage at a third axis, wherein the third axis is located below the first axis;

a second link mechanism rotationally coupled to said second carriage at a fourth axis, wherein the fourth axis is located below the second axis; and a process tool mounting means supported at terminal ends of said first and second link mechanisms, wherein said guide rails are fixed and said modular system is elevated above the article on opposite sides of the path.

39. The robot according to claim 38 wherein each of said guide rails supports at least another of said carriages and link mechanisms.

40. The robot according to claim 38 wherein said process tool mounting means includes a multiple axis wrist mechanism controlled by said control system.

41. The robot according to claim 38 wherein said first and second link mechanisms include fifth and sixth axes of rotation respectively and said first through sixth axes each extend in a substantially horizontal orientation.

* * * * *